US005896409A

United States Patent [19]

Pavlicevic et al.

[11] Patent Number: 5,896,409

[45] Date of Patent: Apr. 20, 1999

[54] FUME INTAKE AND COOLING DEVICE FOR ELECTRIC ARC FURNACES

[75] Inventors: Milorad Pavlicevic, Udine, Italy; Peter Tishchenko, Donezk, Ukraine; Alfredo Poloni, Fogliano di Redipuglia; Alessandro Martinis, Udine, both of Italy

[73] Assignee: Danieli & C. Officine Meccaniche SpA, Buttrio, Italy

[21] Appl. No.: 08/847,510

[22] Filed: Apr. 24, 1997

[30] Foreign Application Priority Data

May 13, 1996 [IT] Italy ..... UD96A0077

[51] Int. Cl.[6] ..... F27D 17/00

[52] U.S. Cl. ..... 373/8; 373/2; 373/8; 373/73; 373/77; 266/158

[58] Field of Search ..... 373/2, 8, 9, 71, 373/73, 74, 77; 266/144, 145, 148, 149, 157–159; 110/203, 204, 215

[56] References Cited

U.S. PATENT DOCUMENTS

| | | | |
|---|---|---|---|
| 3,740,930 | 6/1973 | Cullom | 266/15 |
| 4,077,614 | 3/1978 | Udo et al. | 266/159 |
| 4,350,280 | 9/1982 | Kruse | 266/158 |
| 4,477,910 | 10/1984 | Nijhawan et al. | 373/9 |
| 5,344,122 | 9/1994 | Vuillermoz et al. | 266/79 |

FOREIGN PATENT DOCUMENTS

| | | |
|---|---|---|
| 197207 | 10/1986 | European Pat. Off. . |
| 495694 | 7/1992 | European Pat. Off. . |
| 2399636 | 3/1979 | France . |
| 2663868 | 1/1992 | France . |

*Primary Examiner*—Tu B. Hoang

*Attorney, Agent, or Firm*—Stevens, Davis, Miller & Mosher, L.L.P.

[57] ABSTRACT

Fume intake and cooling device for intake conduits (11,111, 211) in electric arc furnaces (26*a*,26*b*), comprising a containing structure (28) associated at one end (12) with an aperture on the roof of the furnace and connected at the second end (13) with an intake and filter system (27), the containing structure (28) having, in cooperation with its inner sidewalls, cooling means, the cooling means comprising a pipe (14), which is spiral shaped and has turns (16) lying on a plane substantially at right angles to the longitudinal axis of the conduits (11,111,211), the turns (16) being distanced with respect to each other in such a way as to form interstices (20) between adjacent turns (16), the interstices (20) through which the fumes pass serving to anchor the slag.

20 Claims, 2 Drawing Sheets

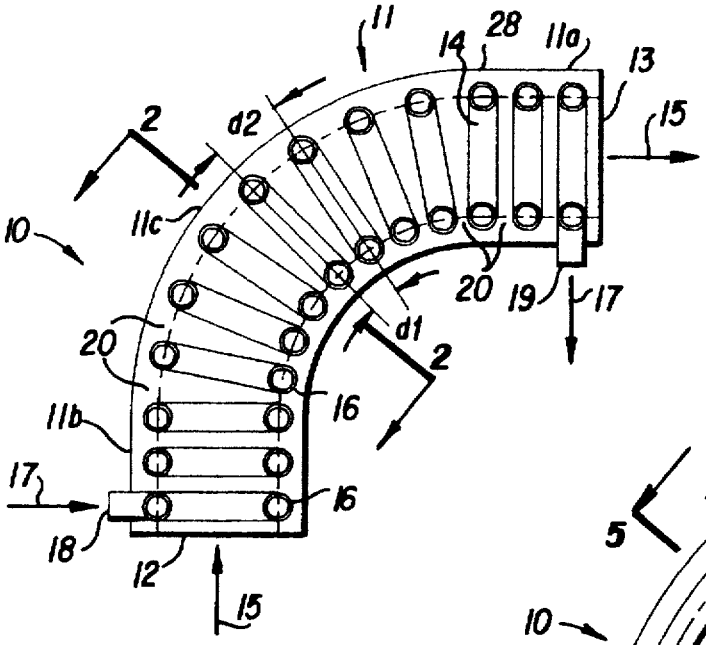
FIG. 1
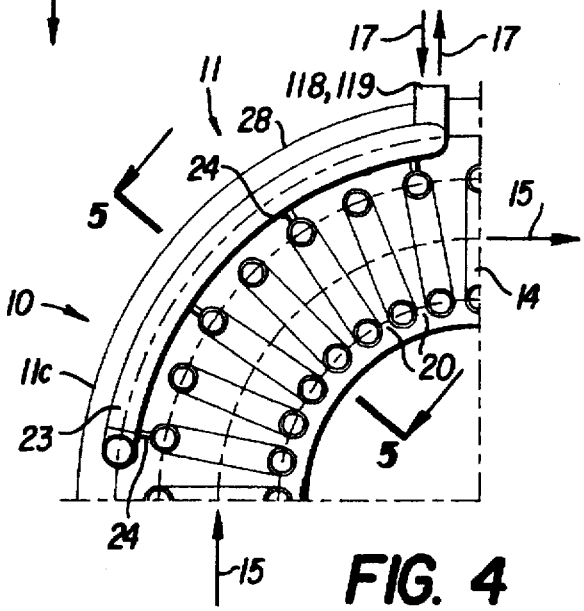
FIG. 4
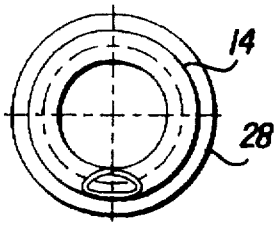
FIG. 2
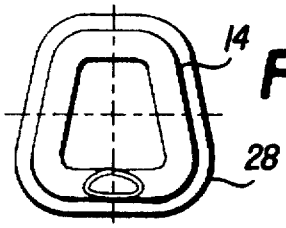
FIG. 3
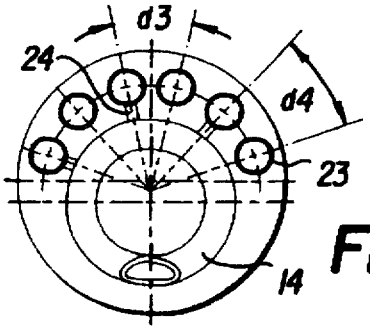
FIG. 5
FIG. 6
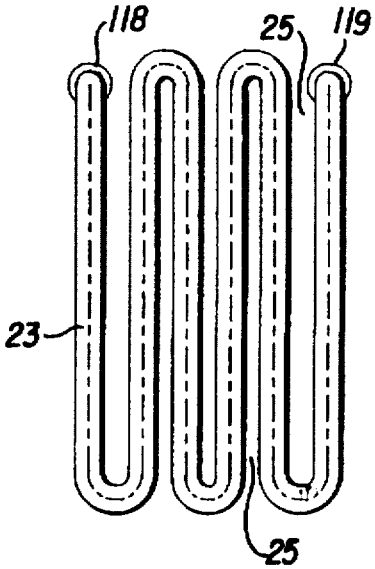

FUME INTAKE AND COOLING DEVICE FOR ELECTRIC ARC FURNACES

FIELD OF THE INVENTION

This invention concerns a fume intake and cooling device for electric arc furnaces.

The invention is applied to the conduits which take in and expel the fumes in electric arc furnaces used in the field of the melting of metals.

BACKGROUND OF THE INVENTION

Roofs used to cover electric arc furnaces normally have a central aperture to position and move the electrodes, and an aperture placed at a peripheral position through which the fumes and volatile slag are expelled by means of intake conduits associated with intake and filter systems.

The intake conduits can have a first L-shaped segment, connected to the roof of the furnace, associated with one or more conduits downstream connected to the intake and filter systems.

These conduits normally have a system to cool the fumes which serves to lower the temperature of the fumes so that they reach the outlet to the atmosphere at a lower temperature.

Moreover, a reduction in the temperature of the fumes makes it possible to use cheaper intake and filter systems as well as to reduce wear on the said systems during operation.

The cooling is usually achieved by means of the circulation of water in the appropriate pipes placed inside the intake conduits.

Cooling devices known to the state of the art provide a spiral shaped pipe, in which the cooling liquid flows, arranged around the periphery of the intake conduit.

The spiral shaped pipes known to the state of the art have their turns in contact with each other and attached to each other in such a way as to form a single rigid structure confining the intake conduit inside.

Therefore these structures have a configuration which implies a considerable volume of work, with regards to the heat flow exchanged, which is concentrated on the inner surface in that their outer surface is not lapped by the fumes. Moreover, this type of structure has a low resistence to thermomechanical stresses because the lack of flexibility of its conformation, if subjected to sudden heat variations, causes stresses on the surfaces of the pipes which may lead to breakages.

According to another solution, in order to increase the resistence of the pipes, an insulating layer of refractory material is applied to the heat-absorbing surfaces of the pipes themselves, but this causes a considerable increase in costs. Moreover, deposits of slag may accumulate on this refractory layer, which cause incrustations and compromise the efficient expulsion of the fumes.

A further problem with conduits known to the state of the art is that welds are required to join individual elements in order to form a single pipe of the desired length.

These welds constitute critical points and create stresses along the pipe which may cause them to break, with the resulting dangerous and harmful spillage of water.

SUMMARY OF THE INVENTION

The present applicants have designed, tested and embodied this invention to overcome the shortcomings of the state of the art and to achieve further advantages.

This invention is set forth and characterized as follows.

The purpose of this invention is to provide a fume intake and cooling device for electric arc furnaces which has a high resistence to thermomechanical stresses.

A further purpose is to obtain a device with low running costs, and which will increase the working life of the intake conduit and the intake and filter units associated with it.

Another purpose is to obtain an intake and cooling device with a lower risk of breaking or accumulating incrustations of slag.

A further purpose is to obtain the formation of small vortexes of cooler gas in the interstice created by the invention, which ensures greater safety and limits loss of energy.

The device according to the invention is applied both to curved and/or L-shaped conduits and to straight or substantially straight conduits.

The device according to the invention comprises a spiral shaped pipe arranged inside the containing structure defining the conduit to expel the fumes.

The turns of this spiral shaped pipe lie substantially on a plane perpendicular to the longitudinal axis of the containing structure.

In a first embodiment, the spiral shaped pipe is made of a continuous pipe, open like a spring, and follows the containing structure coaxially and substantially for its whole length.

According to a variant, the spiral shaped pipe is composed of several spiral shaped sections joined at the ends to form a single and continuous pipe.

The joints between the ends of the pipes are welded at points outside the containing structure and therefore not subject to particular heat stress. In this way a continuous tubular structure is obtained, without any welds at critical points, and therefore not subject to the problems described above.

The containing structure and the spiral shaped pipe can have the same section, for example circular, oval or even polygonal, or they can have different sections so as to accentuate the movement of the fluids.

The ends of the spiral shaped pipe come out of the containing structure so as to make apertures for the intake/discharge of the fluid.

According to the invention, the spiral shaped pipe has a pitch, or distance between the turns, which is always greater than the diameter of the pipe used to make it, which leads to the creation of interstices between adjacent turns.

The interstices give the fumes which lap the pipe a vast surface of heat exchange, because both the inner surface and the outer surface of the spiral shaped pipe are affected by the passage of the fumes.

The greater surface area which is affected by the heat exchange does not lead to a greater heat flow, but causes a reduction in the heat flow exchanged between the hot gases and the pipes; this is because the particular configuration of turns separated by interstices causes vortexes to be formed around the pipes, and these vortexes help protect the pipes from the heat stresses due to the hot gases.

Moreover, in the interstices between the turns, slag suspended in the fumes accumulates and anchors itself to the pipes, and in a very short time it forms an insulating layer able to retain the heat and therefore reduce the heat flow exchanged.

The formation of such a layer of slag in the interstices creates, in cooperation with the turns, a conduit for the passage of the fumes. This conduit retains heat, and therefore the succeeding slag which deposits itself on the walls of the conduit so formed is not allowed to cool immediately, thus preventing the formation of incrustations which would obstruct the conduit and compromise the intake of the fumes.

Another factor which causes the reduction in heat flow is that the overall length of the cooled pipe is reduced by the presence of the interstices between the adjacent turns.

This reduction in the intensity of the cooling, due to the presence of the interstices between the turns, also contributes to make the slag return to a liquid state, so it re-enters the furnace and runs along the walls of the conduit.

Another advantage is that the interstices between the turns give the pipe an elasticity which increases its resistence to thermomechanical stresses.

According to the invention, in correspondence with a curved segment of the conduit, for example in the case of an L-shaped conduit, the spiral shaped pipe has a lesser pitch on the radius of the inner curve than that on the radius of the outer curve.

According to a variant of the invention, the spiral shaped pipe cooperates on the outside with another cooling pipe, of a serpentine-shaped shape, arranged between the spiral shaped pipe and the containing structure, and forming a kind of bow-shaped cover for the spiral shaped pipe.

If the conduit is L-shaped, the serpentine-shaped pipe is advantageously placed in correspondence with the greater radius, where the turns of the spiral shaped pipe have a greater pitch and therefore a lesser heat exchange.

In this case, according to a variant, the turns of the serpentine-shaped pipe do not have a constant pitch but one which grows progressively in proportion to the reduction in pitch between the turns of the spiral shaped pipe.

The ends of the serpentine-shaped pipe also exit from the containing structure so as to form a first aperture for the immission of the cooling fluid and a second aperture for the discharge of said liquid.

According to a variant, the spiral shaped pipe and the serpentine-shaped pipe are associated with each other by means of plates which are not cooled. The plates allow the slag to accumulate in the interstices between the spiral shaped pipe and the serpentine-shaped pipe.

This embodiment gives a further reduction in running costs in that the slag retains the heat and prevents a rapid cooling of the surface of the pipes.

The density of the turns in the cooling pipes, both spiral and serpentine-shaped, can be varied as required to obtain a greater or lesser coefficient of heat exchange, and therefore a greater or lesser cooling of a particular segment of the containing structure according to requirements.

BRIEF DESCRIPTION OF THE DRAWINGS

The attached figures are given as a non-restrictive example and show some preferred embodiments of the invention as follows:

FIG. 1 shows a transverse section of the cooling device according to the invention;

FIG. 2 shows the section 2—2 of FIG. 1;

FIG. 3 shows a variant of FIG. 2;

FIG. 4 shows a variant of FIG. 1;

FIG. 5 shows the section 5—5 of FIG. 4;

FIG. 6 shows the serpentine-shaped pipe of FIG. 4 from above;

DETAILED DESCRIPTION OF THE PREFERRED EMBODIMENTS

The reference number 10 in the attached figures denotes generally the fume intake and cooling device for electric arc furnaces in its entirety.

Figure 7:
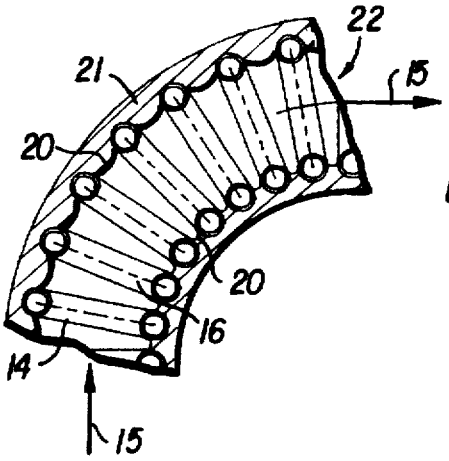
FIG. 7 shows a partial view of the cooling device shown in FIG. 1 after several casting cycles.
Figure 8:
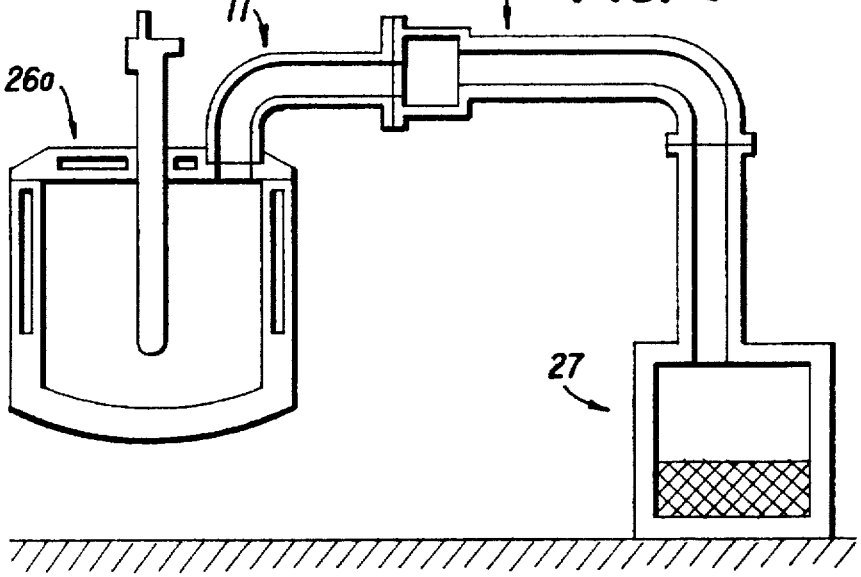
FIGS. 8 and 9 show in diagram form two possible electric arc furnaces to which the device according to the invention can be applied.
Figure 9:
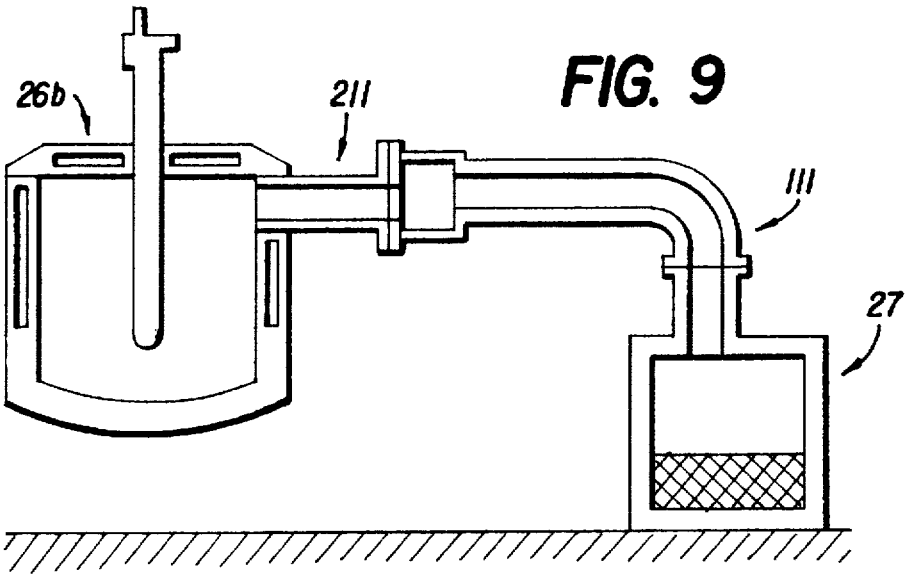

FIGS. 8 and 9 illustrate diagrammatically two possible electric arc furnaces 26*a* and 26*b* to which the device 10 according to the invention can be applied.

In FIG. 8, the furnace 26*a* has a fume intake conduit with an L-shaped first segment 11 connected to the roof and a second segment 111 connected to the intake and filter systems 27.

In FIG. 9, the furnace 26*b* has the first substantially straight intake segment 211 connected to the second segment 111.

In FIG. 1, the device 10 is shown with an L-shaped conduit, to mean that the use of the device 10 can be extended to conduits downstream 111 or straight conduits 211.

The conduit 11 to expel the fumes 15 shown in FIG. 1 has a straight upper segment 11*a* and a straight lower segment 11*b* connected to each other by an L-shaped segment 11*c*.

The conduit 11 has a containing structure 28 with a lower mouth 12 connected to the fume discharge aperture of an electric arc furnace and an upper mouth 13 connected, directly or by means of the conduit 111, to the fume intake and filter system 27.

Inside and coaxial to this structure 28, there is a spiral shaped pipe 14 composed of a continuous pipe bent into turns 16 which are separated from each other, said turns having a substantially constant pitch in the straight segments 11*a* and 11*b* and a variable pitch in the L-shaped segment 11*c*.

Along the segment 11*c* the spiral shaped pipe 14 has, in correspondence with the inner radius of curvature, a pitch d1 which is less than d2 present in correspondence with the outer radius of curvature.

In any case, the minimum pitch d1 of the turns 16 is always greater than the diameter of the pipe, thus guaranteeing the permanent presence of interstices 20 between the turns 16.

In FIG. 2, the structure 28 and the spiral shaped pipe 14 both have a circular section, while in the variant shown in FIG. 3 they both have a trapezoid section with connected corners.

In the spiral shaped pipe 14, the water 17 is fed by means of an intake mouth 18 and discharged by means of an outlet mouth 19, both mouths 18 and 19 exit from the structure 28 by means of water tight connections between the volumes inside and outside the structure 28.

The fumes 15, flowing inside the conduit 11, lap the spiral shaped pipe 14 both on its inner surface and on its outer surface. After a few casting cycles, this causes the slag which is suspended in the fumes 15, to accumulate and deposit itself in the interstices 20 so as to form an insulating layer 21 which defines, in cooperation with the turns 16, the fume intake channel 22. The same interstices 20 moreover cause vortexes to form around the pipe 14.

The channel 22 is not subjected to any further accumulation of incrustations because the insulating layer 21 retains the heat and prevents the rapid cooling of other slag which settles on the inner surface of the turns 16. This slag returns to a liquid state and falls back into the furnace.

According to the variant shown in FIG. 4, in order to increase the coefficient of heat exchange, the conduit 11 has, at least in correspondence with the outer radius of curvature of the L-shaped segment 11*c* where the spiral shaped pipe has a greater pitch, a serpentine-shaped pipe 23 composed of a continuous pipe as shown in FIG. 6.

To be more precise, the serpentine-shaped pipe 23 is arranged in the space between the structure 28 and the spiral shaped pipe 14; it is shaped like a bow to partially cover the spiral shaped pipe 14. In this case, the longitudinal axis of the spiral shaped pipe 14 does not coincide with the longitudinal axis of the conduit 11 as in FIG. 1, but parallel to it, and displaced towards the inner radius of curvature.

The serpentine-shaped pipe 23 has a variable pitch which goes from a minimum value of d3, in correspondence with the upper point of the L-shaped curve and therefore where the spiral shaped pipe 14 has its greater pitch, to a maximum value d4 in relation to the reduction of the pitch of the spiral shaped pipe 14. The minimum pitch d3 is advantageously greater than the diameter of the pipe in such a way as to define the presence of interstices 25 through which the fumes pass and on which the slag is anchored, the interstices 25 relating to the serpentine-shaped pipe 23.

The serpentine-shaped pipe 23 has a water intake mouth 118 and a water discharge mouth 119 both exiting from the conduit 11.

Between the pipe 14 and the pipe 23 there are connecting plates 24 which are not cooled and which guarantee the accumulation of slag in the interstices between the spiral shaped pipe 14 and the serpentine-shaped pipe 23 as well as in the interstices 25 of the serpentine-shaped pipe 23 itself.

In this way, the heat exchange coefficient is increased and the above mentioned advantages for both pipes 14 and 23 are maintained.

According to a variant not shown here, the spiral shaped pipe 14 has protruding means on its surface which further encourage a greater accumulation of slag on the pipes.

We claim:

1. A fume intake and cooling device for an electric arc furnace (26*a*, 26*b*), comprising a containing structure (28) defining an intake conduit (11, 111, 211) for the furnace, the containing structure being associated at one end (12) with an aperture on the roof of the furnace, and connected at the other end (13) with an intake and filter system (27), and cooling means, the cooling means being within the containing structure (28) to be in cooperation with inner sidewalls of the containing structure (28), wherein the cooling means comprises a spiral shaped pipe (14) having turns (16) lying on a plane substantially at right angles to a longitudinal axis of the conduit (11, 111, 211) and the turns are distanced one from the other in such a way as to form interstices (20) between adjacent turns (16), the interstices (20) throughout which the fumes pass serving to anchor slag from the fumes.

2. The device as in claim 1, in which within the containing structure (28), between the spiral shaped pipe (14) and at least one of the inner sidewalls of the containing structure (28), there is a serpentine-shaped pipe (23) arranged in a bow shape to cover at least a segment of the spiral shaped pipe (14).

3. The device as in claim 1, in which the turns (16) of the spiral shaped pipe (14) have a substantially constant pitch in a straight segment (11*a*, 11*b*) of the conduit and a variable pitch in a curved segment (11*c*) of the conduit.

4. The device as in claim 3, wherein the conduit has the curved segment (11*c*), and in correspondence with the curved segment (11*c*) the pitch (d2) in the outer radius of the turns (16) is higher than the pitch (d1) of the inner radius.

5. The device as in claim 2, in which in correspondence with a curved segment (11*c*) of the conduit, the serpentine-shaped pipe (23) has a variable pitch which goes from a minimum value (d3) to a maximum value (d4) in relation to the reduction in the pitch of the spiral shaped pipe.

6. The device as in claim 4, in which the respective pitch (d1) of each of the turns of the spiral shaped pipe (14) is greater than the diameter of the pipe with which the spiral shaped pipe is made.

7. The device as in claim 2, in which the spiral shaped pipe (14) and serpentine-shaped pipe (23) are, respectively, made of a single, continuous pipe, bent and without welds.

8. The device as in claim 2, in which the spiral shaped pipe (14) and serpentine-shaped pipe (23) comprises segments joined at the ends outside the containing structure (28) so as to respectively form a continuous single pipe (14/23).

9. The device as in claim 8, in which each single pipe (14, 23) has its own inlet (18,118) and its own outlet (19,119) for the cooling fluid.

10. The device as in claim 2, in which the spiral shaped pipe (14) and the serpentine-shaped pipe (23) are connected by uncooled plates (24) to anchor the slag.

11. The device as in claim 1, in which at least the containing structure (28) has a substantially circular section.

12. The device as in claim 1, in which the containing structure (28) has a substantially polygonal section.

13. The device as in claim 1, in which the spiral shaped pipe (14) is arranged on the circumference in accordance with the section of the containing structure (28).

14. The device as in claim 5, in which the respective pitch (d3) of each of the turns of the serpentine-shaped pipe (23) is greater than the diameter of the pipe with which the serpentine-shaped pipe (23) is made.

15. The device as in claim 1, in which the spiral shaped pipe (14) is made of a single, continuous pipe, bent and without welds.

16. The device as in claim 2, in which the serpentine-shaped pipe (23) is made of a single, continuous pipe, bent and without welds.

17. The device as in claim 1, in which the spiral shaped pipe (14) comprises segments joined at the ends outside the containing structure (28) so as to form a continuous pipe (14).

18. The device as in claim 2, in which the serpentine-shaped pipe (23) comprises segments joined at the ends outside the containing structure (28) so as to form a continuous pipe (23).

19. The device as in claim 7, in which each single pipe (14, 23) has its own inlet (18, 118) and its own outlet (19, 119) for the cooling fluid.

20. The device as in claim 1, wherein the spiral shaped pipe (14) is made of a single continuous pipe, bent without welds.

* * * * *